US005177536A

United States Patent [19]

Watanabe et al.

[11] Patent Number: 5,177,536

[45] Date of Patent: Jan. 5, 1993

[54] DEVELOPING APPARATUS HAVING A MAGNETIC SEAL

[75] Inventors: Akira Watanabe; Masahiro Itoh; Yuji Sakemi, all of Yokohama; Hiroshi Satomura, Hatogaya, all of Japan

[73] Assignee: Canon Kabushiki Kaisha, Tokyo, Japan

[21] Appl. No.: 499,729

[22] Filed: Mar. 27, 1990

[30] Foreign Application Priority Data

| | | | |
|---|---|---|---|
| Mar. 31, 1989 | [JP] | Japan | 1-082849 |
| May 31, 1989 | [JP] | Japan | 1-138953 |
| Jun. 13, 1989 | [JP] | Japan | 1-149889 |
| Jun. 13, 1989 | [JP] | Japan | 1-149891 |

[51] Int. Cl.[5] ..... G03G 15/09; G03G 21/00

[52] U.S. Cl. ..... 355/251; 355/215

[58] Field of Search ..... 355/215, 251, 253; 118/657, 658

[56] References Cited

U.S. PATENT DOCUMENTS

| | | | |
|---|---|---|---|
| 3,788,275 | 1/1974 | Hanson | 118/637 |
| 3,915,121 | 10/1975 | Wilcox | 118/637 |
| 4,213,617 | 7/1980 | Salger | 277/12 |
| 4,341,179 | 7/1982 | Hosono et al. | 118/658 |
| 4,373,468 | 2/1983 | Suda et al. | 118/658 |
| 4,377,332 | 3/1983 | Tamura | 355/253 |
| 4,380,966 | 4/1983 | Isaka et al. | 118/651 |
| 4,387,664 | 6/1983 | Hosono et al. | 118/658 |
| 4,395,476 | 7/1983 | Kanbe et al. | 430/102 |
| 4,449,810 | 5/1984 | Ikesue et al. | 355/3 DD |
| 4,563,978 | 1/1986 | Nakamura et al. | 118/658 |
| 4,596,455 | 6/1986 | Kohyama et al. | 118/657 X |
| 4,597,661 | 7/1986 | Yamashita | 118/658 X |
| 4,748,474 | 5/1988 | Kurematsu et al. | 355/15 |
| 4,777,107 | 10/1988 | Kurematsu et al. | 130/122 |
| 4,806,971 | 2/1989 | Masham | 118/657 X |
| 4,838,200 | 6/1989 | Hosoi et al. | 118/658 |
| 4,844,008 | 7/1989 | Sakemi et al. | 118/658 |
| 4,897,693 | 1/1990 | Sawayama | 355/215 |
| 4,933,254 | 6/1990 | Hosoi et al. | 430/122 |

FOREIGN PATENT DOCUMENTS

| | | | |
|---|---|---|---|
| 0219233 | 4/1987 | European Pat. Off. . | |
| 0314436 | 5/1989 | European Pat. Off. . | |
| 0348138 | 12/1989 | European Pat. Off. . | |
| 56-120819 | 9/1981 | Japan . | |
| 57-30859 | 2/1982 | Japan . | |
| 58-29479 | 6/1982 | Japan . | |
| 59-170869 | 9/1984 | Japan . | |
| 60-28673 | 2/1985 | Japan . | |
| 60-151668 | 8/1985 | Japan . | |
| 61-172173 | 8/1986 | Japan . | |
| 62-70884 | 4/1987 | Japan . | |
| 62-73283 | 4/1987 | Japan . | |
| 63-61277 | 3/1988 | Japan | 355/260 |
| 64-08211 | 2/1989 | Japan . | |

OTHER PUBLICATIONS

Xerox Disclosure Journal, "Magnet For Toner Contamination Control", vol. II, No. 1, Jan./Feb. 1986.

*Primary Examiner*—Fred L. Braun

*Attorney, Agent, or Firm*—Fitzpatrick, Cella, Harper & Scinto

[57] ABSTRACT

A developing apparatus is provided with a container for accommodating a developer for containing magnetic particles, and a rotatable carrying member is disposed at least partly in the container and faces an image bearing member at a developing station. The rotatable developer carrying member carries the developer thereon to the developing position. A magnet is disposed in the developing carrying member and includes a plurality of magnets for conveying the developer. A magnetic member is disposed close to the circumferential surface of the developer carrying member and in a circumferential direction of the developing carrying member in a region thereof where the developer carrying member is disposed in the developer container, adjacent to a longitudinal end of the developer carrying member. The magnetic member is magnetized by the magnet and the magnetic member cooperates with the magnet to form a magnetic field for forming a magnetic brush of the developer in a gap between the magnetic member and the developer carrying member.

42 Claims, 9 Drawing Sheets

DEVELOPING APPARATUS HAVING A MAGNETIC SEAL

FIELD OF THE INVENTION AND RELATED ART

The present invention relates to a developing apparatus for developing an electrostatic latent image formed on an image bearing member through an electrophotographic process or an electrostatic recording process, more particularly to a developing apparatus using a one component developer containing as a major component magnetic toner particles and a two component developer containing magnetic carrier particles and toner particles.

U.S. Pat. No. 4,387,664 and European Patent Application 0,219,233A disclose that a magnetic member is disposed extending along the length of a developer carrier member at a developer layer thickness regulating portion in the outlet of the developer where a developer carrying member displaces the developer from the container toward a developing station. The magnetic member is disposed in a magnetic field provided by a magnet contained within the developer carrying member to regulate the thickness of the developer layer.

U.S. Pat. Nos. 4,563,978 and 4,838,200, and European Patent Application No. 0,219,233A disclose a developing apparatus including a magnetic member length of the developer carrying member at an inlet for the developer where the developer carrying member returns into the container the developer having passed through the developing station. The magnetic member is also disposed within the magnetic field of the magnet within the developer carrying member to prevent the developer from flowing out through the inlet to the outside.

U.S. Pat. Nos. 4,341,179 and 4,373,468 disclose means for preventing the developer from leaking out from the longitudinal ends of the developer carrying member. In this developing apparatus, as shown in FIG. 1, sealing members 14 are made of mode plane or non-woven fabric at the opposite longitudinal ends of the developer carrying member 10*b*. As shown in FIG. 2, an elastic sealing members 16 having elastic contact tongues 16*a* for assuring the contact thereof with the developer carrying member 10*b* are contacted to the longitudinal opposite ends of the developer carrying member 10*b*. Using such end sealing members, the developer is prevented from leaking out of the container beyond the longitudinal ends of the developer carrying member, or the developer from being introduced into bearings 12 of the developer carrying member.

However, with such a conventional structure, the developer can get into the contact portion between the end seal members 14 and 16 and the developer carrying member 10*b* although the amount thereof is small. Therefore, when the developing apparatus is operated for a long period, the developer is rubbed by the press-contact portion with the result of agglomeration of the developer.

A part of the agglomeration is taken into the other developer, but in the case where the agglomeration is large, it is blocked by the developer layer thickness regulating blade with the result of occurrence of the developer non-application portion on the developer carrying member 10*b*, by which a white stripe appears on the resultant image.

When the agglomeration is small, it is consumed during the developing operation together with the other developer particles. This results in nontransfer portion about the agglomerated developer, particularly in the case of a solid black image, which appears as white dots in the transferred image, thus deteriorating significantly the image quality. If the contact pressure between the end seal member and the developer carrying member is increased in an attempt to prevent this, a remarkably strong stress is applied to the developer carrying member with the result of an increase of the load of the developer carrying member driving motor. Therefore, it has been difficult to completely prevent the leakage of the developer over a long period of time.

The recent demand in the field of printers and copying machines is directed to color images and graphic images, in which case the reproducibility of a half tone image or a solid image become important. In order to accomplish the high image quality suitable for them, the grain size of the developer is reduced, and on the other hand, an alternating electric field is applied at the developing position for improving the developing performance, as disclosed in U.S. Pat. No. 4,395,476 or in a European Patent Application No. 0,219,233A.

By reducing the size of the developer, particularly the toner particles, it generally becomes more easily agglomerated, and the application of the alternating electric field tends to promote the agglomerated developer deposition on the developed image. In the case of the color image formation, the agglomeration of the developer is a significant problem from the standpoint of further improvement in the image quality. This is because in the color image, subtle colors are represented by overlaying plural color toners, and therefore, if the above-described defect is involved in one of the color images, the resultant image involves the defect which is remarkable.

SUMMARY OF THE INVENTION

Accordingly, it is a principal object of the present invention to provide a developing apparatus wherein the developer is prevented from being stressed by the end sealing members and the developer carrying member, such as a developing sleeve with the result of developer agglomeration or fusing.

It is another object of the present invention to provide a developing apparatus wherein the leakage of the developer from the longitudinal ends of the developer carrying member is effectively prevented without significantly increasing the load for driving the developer carrying member.

It is a further object of the present invention to provide a developing apparatus wherein the agglomeration of the developer attributable to the provision of the sealing members is prevented to increase the quality of the image.

It is a further object of the present invention to provide a developing apparatus capable of forming a developed image with a high resolution.

It is a further object of the present invention to provide a developing apparatus which is suitable to producing a high quality color image.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
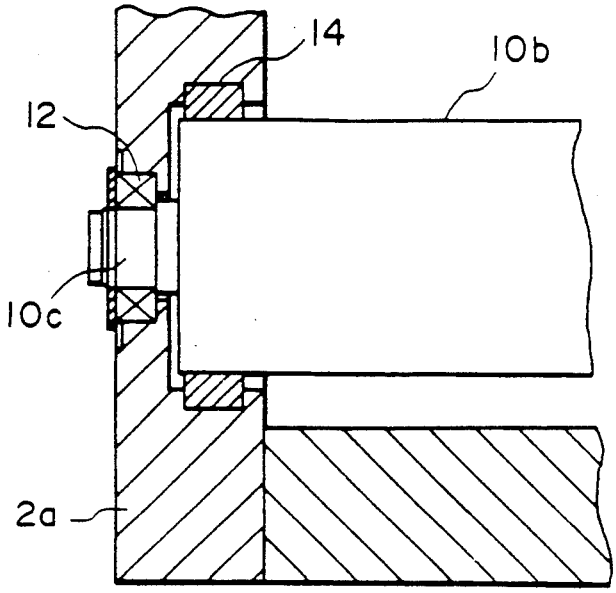
FIG. 1 PRIOR ART
FIG. 1 is a partial cross-sectional view of a portion of a conventional developing apparatus.
Figure 2:
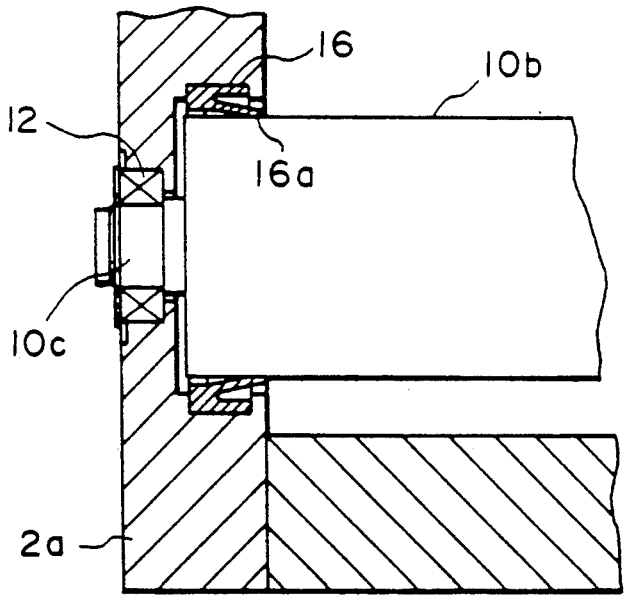
FIG. 2 PRIOR ART
FIG. 2 is a partial cross-sectional view of a conventional developing apparatus.
Figure 3:
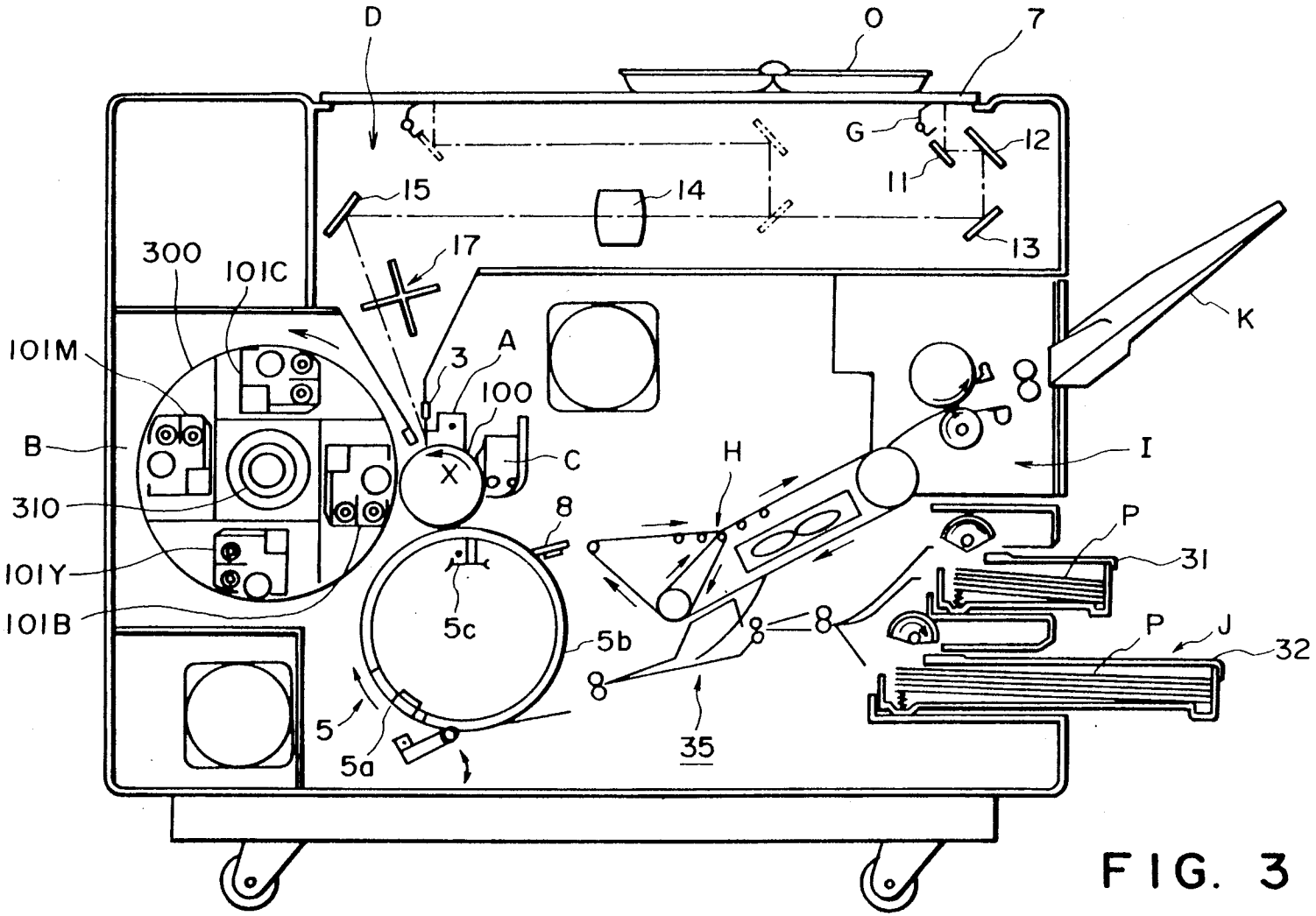
FIG. 3 is a cross-sectional view of a color copying apparatus to which the present invention is applicable.

Referring to FIG. 3, the description will first be made as to a full-color electrophotographic copying apparatus to which the present invention is applicable. Generally at the center of the copying machine, there is disposed a photosensitive drum 100 functioning as an image bearing member and having a surface electrophotographic photosensitive layer. It is rotatable in the direction indicated by an arrow x direction (counterclockwise direction).

Above the photosensitive drum 100, a primary charger A is disposed; to the left of the photosensitive drum 100, a rotary type developing device B is disposed; below the photosensitive drum 100, a transfer device 5 is disposed; and to the right of the photosensitive drum 1, a cleaning device C is disposed.

At the top portion of the electrophotographic copying machine, there is disposed an optical system D which functions to project an image of an original O on a transparent platen 7 (glass or the like) onto the photosensitive drum 100 (through a slit) at an exposure station 3 disposed between the primary charger A and the rotary developing device 100 the optical system D may be of any known type. In this embodiment, it comprises a first scanning mirror 11, second and third scanning mirrors 12 and 13 movable in the same direction as the first scanning mirror 11 and at a speed which is one half that of the first scanning mirror 11. Since such an optical system D constitutes a known slit exposure optical system, and therefore, the detailed description thereof is omitted for simplicity.

The original illuminating light source 10 is movable together with the first scanning mirror 11, and a color separation filter 17 is disposed between a fourth fixed mirror 15 and the exposure station 3. The color separation filter 17 includes red, green, blue and ND filters which are selectively introduced into the optical path.

The light image by the light reflected by the original O scanned by the first, second and third mirrors 11, 12 and 13 is passed through a lens 14, is reflected by the fourth fixed mirror 15, and is color-separated by a color separation filter 17. It is imaged on the photosensitive drum 100 at the exposure station.

At the right portion in the full-color electrophotographic copying apparatus, there are an image fixing device I and a sheet feeding device J. Between the image transfer device 5, the fixing device I and the sheet feeding device J, there are transfer material conveying systems 25 and 35.

With the structure described above, the photosensitive drum 100 is subjected to charging, image exposure, developing, transferring and cleaning operations (image forming process operations) by the primary charger A, the optical system D, the rotary developing device B, the transfer device 5 and the cleaning device C, for each of the separated colors.

The rotary developing device B includes a rotatable supporting member 300 and developing units supported on the supporting member 300 at 90 degrees intervals. In this embodiment, the supporting member 300 supports four developing units, more particularly, a developing unit 101Y containing yellow toner, a developing unit 101M containing a magenta toner, a developing unit 101C containing cyan toner and a developing unit 101BK containing black toner. An electrostatic latent image corresponding to each of the colors formed on the surface of the photosensitive drum 100 is visualized with the developer contained in the corresponding developing unit. By controlling the rotational angular position of the supporting member 300 at the increment of 90 degrees, the developing sleeve of a desired developing unit is presented to the predetermined developing position where it is faced to the photosensitive drum 100 to permit developing action by the developing unit. During the developing operation, the developing sleeve is supplied with a developing bias voltage, which is a vibratory voltage such as an AC voltage or a substantially DC biased AC voltage provided by the voltage source E (FIG. 4) so that an alternating or vibratory electric field is formed at the developing position, by which the toner is repeatedly transferred to the photosensitive drum or transferred back to the developing sleeve to finally develop the latent image. The waveform of the bias voltage may be sine wave, rectangular wave, triangular wave or the like. In the state shown in FIG. 3, the black developing unit 101BK is presented to the photosensitive drum 100.

The developing device may be of a regular development type wherein a dark potential portion of the latent image receives the toner or a reverse-development wherein a light potential portion of the latent image receives the toner. When the reverse-development type is used, the portion of the -photosensitive member to receive the toner is exposed to laser beam modulated in accordance with an image signal or LED radiation or the like.

The visualized image thus provided is transferred onto a transfer material P such as a sheet of paper supplied from the sheet feeding device J, at the image transfer station. The transfer device 5 is provided with a transfer drum 5*b* having a gripper 5*a* for gripping and retaining the transfer material P on the periphery of the transfer drum 5*b*. The gripper 5*a* of the transfer drum 5*b* grips the leading edge of the transfer material P supplied from the transfer material cassette 31 or 32 of the feeding device J through the transfer material conveying system 35, and the transfer drum 5*b* rotates, carrying the transfer material P to transfer the visualized (toner) color images from the photosensitive drum 100. In the image transfer station, there is a transfer charger 5*c* disposed within the transfer drum 5*b*.

In this manner, the transfer material P receives the color visualized images sequentially and superposedly, and is released from the gripper 5*a* and is separated from the transfer drum 5*b* by a separating pawl. Then, the transfer material P is conveyed by the transfer material conveying system 25 to an image fixing device I, by which the toner image on the transfer material P is heated, fused and fixed on the transfer material P. Thereafter, the transfer material P is discharged to a tray K.

Figure 4:
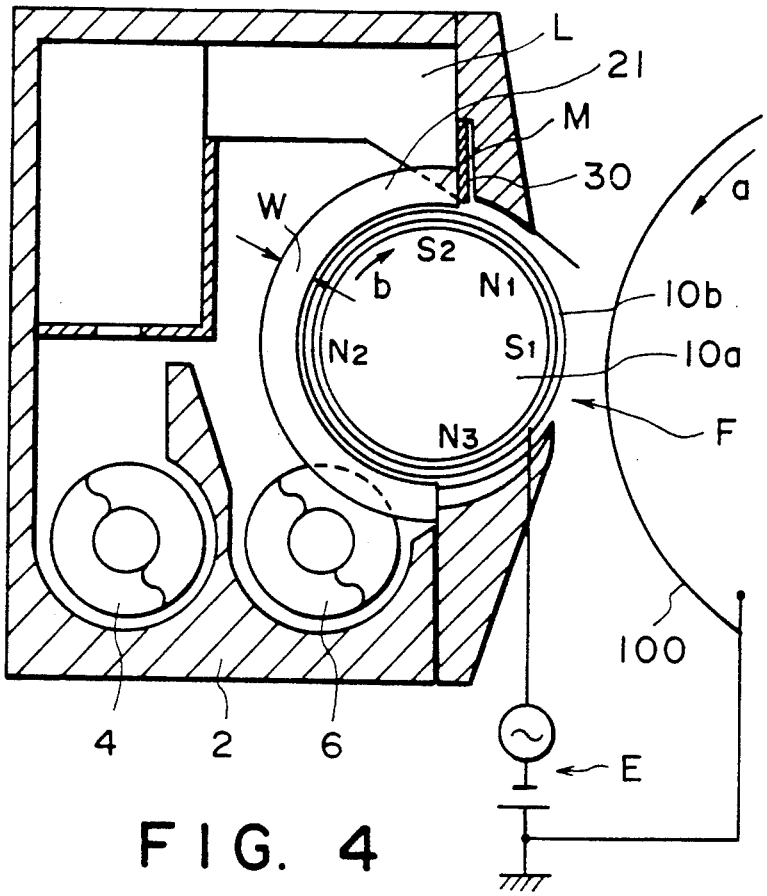
FIG. 4 is a cross-sectional view of a developing apparatus according to an embodiment of the present invention.

FIG. 4 is a cross-sectional view of one of the developing units shown in FIG. 3. The image bearing member 100 (photosensitive drum) is rotated in a direction indicated by an arrow a by an unshown driving device. A developing sleeve 10*b* is faced to the photosensitive drum 100 at the developing position. It is made of non-magnetic material such as aluminum, stainless steel (SUS 316). A substantially left half circumferential surface of the developing sleeve 12 is placed in a developer container 2 through a longitudinal opening thereof. The substantially right half thereof is exposed outside the container 2. It is rotatably supported and is driven to rotate in a direction b.

Within the developing sleeve 10*b* a stationary permanent magnet is provided to produce a stationary magnetic field. When the developing sleeve 10*b* is rotated, the magnet 10*a* maintains its position and pose. The magnet 10*a* has five magnetic poles ("N" indicates N-polarity; and "S" indicates S-polarity). The magnet 10A is not limited to a permanent magnet, but may be an electromagnet.

At the top edge of the opening of the developer supply opening in which the developing sleeve 10*b* is disposed, a developer layer regulating member in the form of a non-magnetic blade 30 is fixed on a wall of the container 2 at its base portion, and the leading edge of the blade 30 is disposed spaced apart from the developing sleeve 10*b* with a small clearance along the length of the sleeve. The non-magnetic blade 30 is made of SUS 316, for example.

A developer guiding member L has a surface closely disposed to a side of the non-magnetic blade 30 and has a bottom surface functioning as a developer guiding surface M. A developer layer thickness regulating portion is constituted by the non-magnetic blade 30, the developer guiding member L or the like. The regulating station regulates the thickness of a layer of the developer discharged from the container 2 and carried to the developing station F, by the rotation of the sleeve 10*b*. The thickness of the developer layer on the sleeve 10*b* is preferably small such that the developer layer is in contact with the drum 100 at the developing station F where the toner is applied from the sleeve 10*b* to the drum 100. However, in the case where plural color toner images are formed on the drum 100 by superposition, the developer layer is preferably regulated into such a thickness that it is not contacted to the drum 100 at the developing station F.

In this embodiment, the developing device is provided with a developer container 2 for containing a developer 8 which may be a one component magnetic developer containing magnetic toner particles each of which is a mixture of a magnetic particle and resin or may be a two component developer which is a mixture of magnetic carrier particles containing as a major component magnetic particles and toner particles. In the developer container 2, there are screws 4 and 6 for reciprocating, circulating and stirring the developer within the developer container 2. In FIG. 4, the developer is omitted for the sake of simplicity. The developer used for the color image forming apparatus described above is preferably the two component developer containing the non-magnetic toner particles and the magnetic carrier particles.

Figure 6:
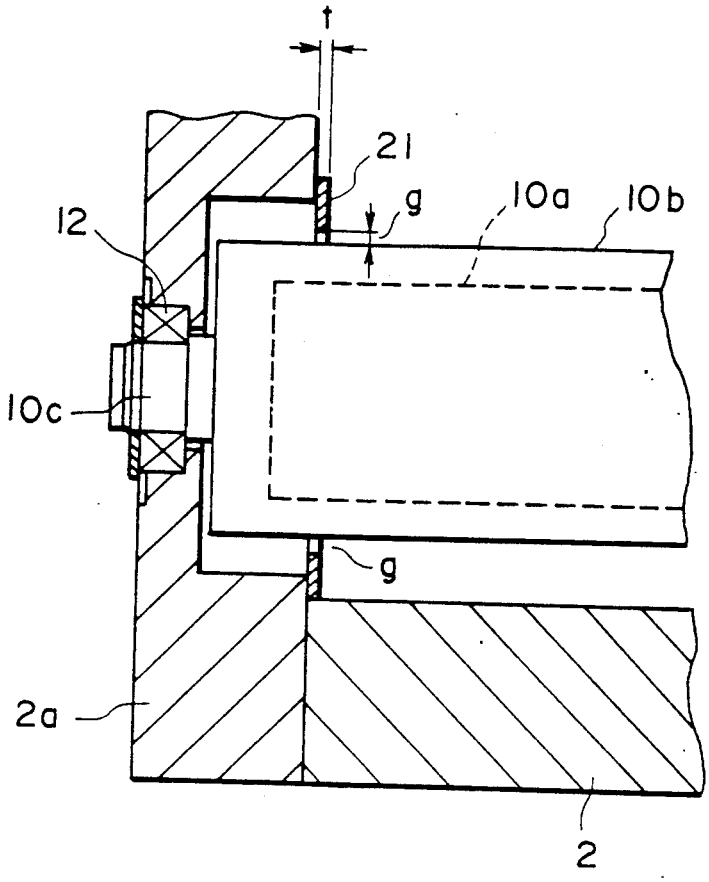
FIG. 6 is a partial cross-sectional view of a longitudinal end portion of the developing sleeve in a developing apparatus according to an embodiment of the present invention.

As shown in FIG. 6, the developing sleeve 10*b* is provided with a shaft projecting outwardly from longitudinal opposite ends thereof (only one end is shown in FIG. 6). The shaft is rotatably supported on the side wall 2*a* of the developer container 2 by bearings 12. The sleeve 10*b* is rotationally driven by a motor through an unshown gear train.

Figure 5:
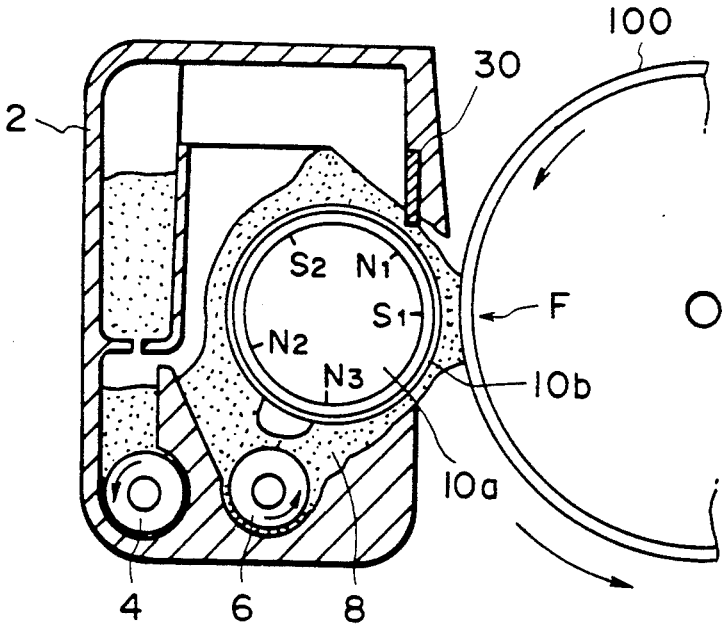
FIG. 5 is a cross-sectional view of the developing apparatus illustrating behavior of the developer.

Similarly to the conventional apparatus, when the developing sleeve 10*b* rotates, the developer caught on the surface of the sleeve by the magnetic force of the pole N2 is conveyed to the pole S2, the pole N1 and to the pole S1. The developer is regulated by the regulating member 30 so that a thin developer layer is formed. A magnetic pole S1 functions as a main developing magnetic pole, and is effective to erect chains of the developer particles by its magnetic field. The chains of the developer develops the electrostatic latent image on the image bearing member 100. Thereafter, by the repelling magnetic field formed by the cooperation of the same polarity N3 and N2 poles, the developer having the development hysteresis on the developing sleeve 10*b* falls into the developing container 2. After the developer is sufficiently stirred by the screw 6, it is supplied to the sleeve again. The behavior of the developer 8 is shown in FIG. 5.

As shown in FIGS. 4 and 6, at each of the longitudinal ends of the developing sleeve 10*b*, a plate-like magnetic member 21 is disposed to enclose such a portion of the developing sleeve 10*b* as is within the container 2, and is mounted on a side wall 2*a* of the developer container 2. The plate-like magnetic member 21 is provided at each of the longitudinal ends of the sleeve 10*b*, extending along the circumferential direction of the sleeve 10*b* with a small clearance from the sleeve 10*b*. The magnetic member 21 is within the influence of the magnetic field provided by the magnet 10*a*. In FIG. 6, for example, only one longitudinal end of the sleeve 10*b* is shown.

The magnetic member 21 is preferably made of ferromagnetic material such as steel, nickel, cobalt or an alloy of two or more of them, having a thickness (t) of 0.2–1 mm. These materials have $(\frac{1}{2})(BH)max$ of not more than 0.7 $J/m^3$, where (BH)max is the maximum of $B \times H$, where B is residual magnetic flux density, and H is coercive force, wherein (BH)max is a maximum energy multiple. The gap g from the developing sleeve 10*b* is not limited, but may be properly selected within the range of 0.3–2 mm.

In this embodiment, the magnetic member 21 has a partial annular configuration, concentric with the developing sleeve 10*b* and has a width w to provide a uniform gap G from the developing sleeve 10*b*. However, the configuration is not limited to this, but may be determined properly by one skilled in the art. It should be noted that the magnetic plate 21 extends along the periphery of the developing sleeve 10*b* without contact thereto. An angle formed between a side surface of the magnetic plate 21 and a line perpendicular to the circumferential surface of the developing sleeve 10*b* is preferably not more than 45 degrees in order to assure prevention of the leakage of the developer.

It is preferable that the magnetic plate 21 extends covering the entire circumferential surface of the developing sleeve 10*b*, but it is not inevitable. As shown in FIG. 4, it may cover a part of the entire circumferential surface of the developing sleeve 10*b*.

Figure 7:
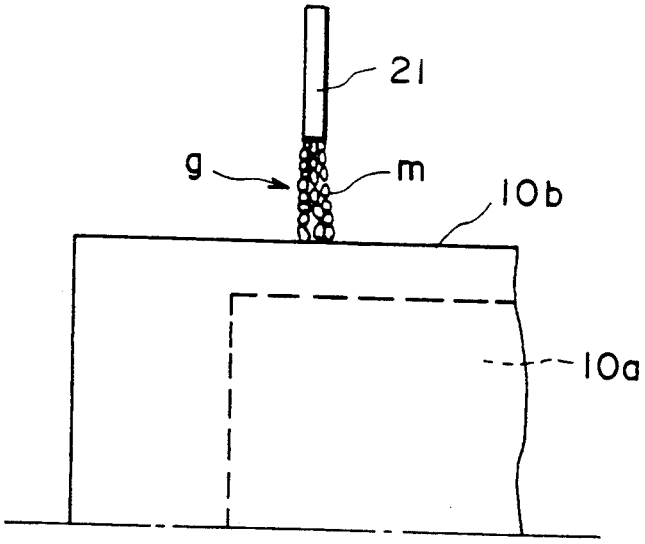
FIG. 7 illustrates magnetic brush formed adjacent a longitudinal end of the developing sleeve.

By disposing the magnetic plates at the longitudinal opposite end portions of the developing sleeve 10*b*, the magnetic plates 21 are magnetized by the magnetic force of the magnetic roller 10*a* in the developing sleeve 10*b*, so that a magnetic circuit is established between the magnetic roller 10*a* and the magnetic plates 21. This is effective to concentrate the magnetic field to the free edge of the magnetic plate 21 adjacent to the developing sleeve 10*b*. Therefore, as shown in FIG. 7, a high density magnetic brush m of the developer particles is formed in the gap g between the magnetic plate 21 and the developing sleeve 10*b*. The magnetic brush m functions to prevent the developer from leaking along the developing sleeve 10*b* through the clearance between the developer container side wall 2*a* and the developing sleeve 10*b* surface into the bearing 12 and to prevent the developer from scattering externally. In other words, the magnetic brush m of the developer formed in the gap g between the magnetic plate and the developing sleeve 10*b*, functions as an end seal (where the developer is the two component developer, the brush m is a magnetic brush of the magnetic carrier particles; and where it is a one component developer, the magnetic brush m is the brush of the magnetic toner).

Figure 8:
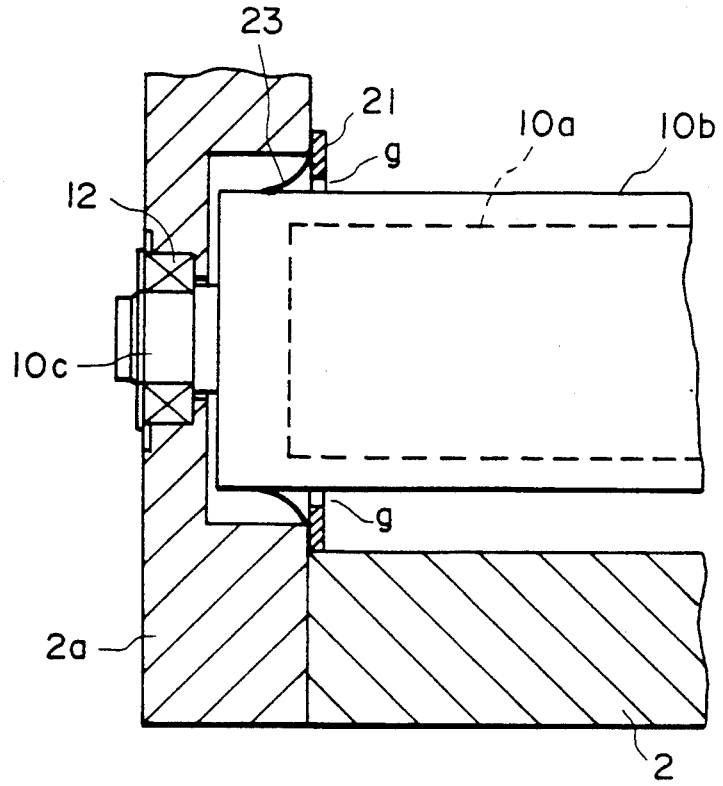
FIG. 8 is a cross-sectional view of a portion of the developing apparatus according to an embodiment of the present invention.

Referring to FIG. 8, another embodiment of the present invention will be described. In this embodiment, an auxiliary sealing member 23 is disposed adjacent to the magnetic plate 21. The auxiliary sealing member 23 is made of an elastic sheet having an inside edge resiliently contacted to the developing sleeve 10*b* at a position between the magnetic plate 21 and the bearing 12, while the elastic sheet being bent. A preferable example of the auxiliary sealing member 23 is made of polyethylene terephthalate, urethane rubber sheet or the like having a thickness of 0.1–0.5 mm, for example. By the provision of the auxiliary sealing member 23, it can be avoided that a part of the magnetic brush formed in the gap between the magnetic plate 21 and the developing sleeve 10*b* scatters toward the bearing 12 with further certainty. The auxiliary sealing member 23 is preferably extended circumferentially within the range in which the magnetic plate 21 circumferentially extends.

Figure 9:
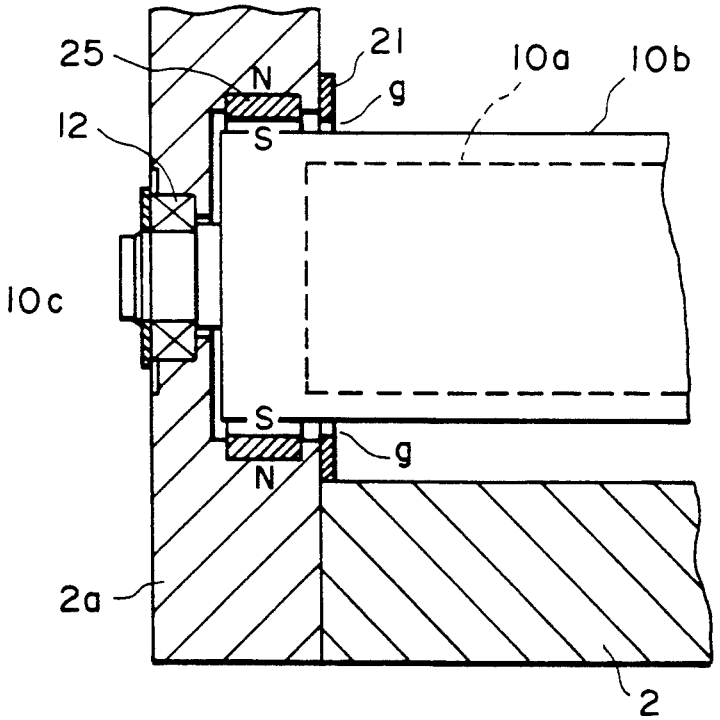
FIG. 9 is a partial cross-sectional view of a developing apparatus according to a further embodiment of the present invention.

Referring to FIG. 9, a further embodiment of the present invention will be described. The number and arrangement of the magnetic poles of the magnet roller 10*a* are not limited to those shown in FIG. 4. If the number and arrangement of FIG. 4 are used, the formation of the magnetic brush of the developer is not so strong in the portion of the gap g adjacent to the portion where the repelling magnetic field is formed by the poles N3 and N2 as the other portions. Therefore, if the developer moves toward the bearing 12 through the portion of the gap g, the developer is caught by a magnet 25 which is an alternative of the auxiliary sealing member. The magnet 25 is a partial annular permanent magnet extending along the peripheral surface of the developing sleeve 10*b* in the region where the magnetic plate 21 exists, at a longitudinal position between the magnetic plate 21 and the bearing 12. The partial annular magnet may comprise a rubber magnet containing magnetic powder dispersed therein or a plastic magnet or the like.

In this embodiment, the inside surface of the partial annular magnet is magnetized to S polarity, and the outer surface side is magnetized to N polarity. It is particularly effective to prevent the leakage of the developer through the region where the repelling magnetic field is formed by the magnetic poles N3 and N2. According to this embodiment, the developer once caught by the magnet 25 is formed into a magnetic brush in the gap between the magnet 25 and the developing sleeve 10*b* surface, and thereafter, the magnetic brush functions to seal the developer against the possible leakage in the region where the repelling magnetic field is formed by the magnetic poles N3 and N2.

The weighted average particle size of the magnetic carrier particles in the two component developer usable with the developing apparatus according to the present invention is 30–100 microns. Preferably, however, it is 35–65 microns, and further preferably it is 40–65 microns. The weighted distribution is preferably such that the component of particle size of not more than 26 microns is not more than 2–6%, that the component of the particle size of 35–43 microns is 5–25% and that the component of the particle size not less than 74 microns is not more than 2%. The electric resistance of the carrier is not less than $50^7$ ohm.cm, preferably not less than $10^8$ ohm.cm, and further preferably $10^9$–$10^{12}$ ohm.cm, and is preferably provided by coating ferrite particles (maximum magnetization) 60 emu/g coated with resin material.

The resistance of the magnetic particle, for example ferrite particles or ferrite particles coated with resin material, is measured using a sandwich type cell having a measuring electrode area of 4 $cm^2$ and a clearance of 0.4 cm between electrodes, wherein the weight of 1 kg is applied on one of the electrodes. A voltage E (V/cm) is applied across the electrodes, and the resistance of the magnetic particles is obtained on the basis of the current through the circuit containing the electrodes.

The preferable toner used in this embodiment satisfy that more than 90% by volume toner particles are within the range of $(\frac{1}{2})M<r<(3/2)M$, where M is a volume average particle size, and r is a particle size of a toner particle; and that more than 99% by volume is within the range of $0<r<2M$. In addition, the volume average particle size M is preferably not more than 10 microns and not less than 4 microns (for the purpose of higher resolution image formation, preferably not more than 10 microns, and further preferably not more than 8 microns).

The volume distribution and the volume average particle size of the toner are measured in the following manner:

The measuring device is Callter Counter TA-II (available from Callter) to which an interface (Nikkaki) and CX-i Personal Computer (available from Canon Kabushiki Kaisha, Japan) for outputting number average distribution and volume average distribution. As for the electrolytic solution, a first class natrium chloride is used to prepare 1% NaCl solution. The electrolytic solution (100–150 ml) is added with 0.1–5 ml of surface active agent (dispersing agent) (preferably alkylbenzene sulfonate) and further added with 0.5–50 mg of the material to be measured.

The electrolytic solution suspending the material is subjected to the dispersing operation approximately 1–3 min. using an ultrasonic dispersing device. Using TA-II with 100 micron aperture, the particle size distribution for the particles having the particle size of 20–40 microns, and the volume distribution is obtained therefrom. From the volume distribution, the volume average particle size of the sample material can be obtained. When the distribution exceeds the above-described range, the image quality improving effect can not be sufficiently expected even if the average particle size is changed when the toner particles having larger particle sizes increase, it is difficult to remove the image roughness at the portion where the image density is low because the large size toner particles contributable to the scattering of the toner are present at the time of the image transfer, however, the average particle size of the toner is reduced.

When the toner particles having the smaller particle size includes the toner particles stuck to the magnetic particles includes. Therefore, the magnetic particles become unable to apply the triboelectric charge efficiently to the toner with the result of increased toner scattering or the foggy background. In addition, the toner particles having small particle size tends to be fused, and therefore, they are fused on the magnetic particles (carrier) with the result of the foggy background and the toner scattering attributable to the carrier deterioration. For the reasons described above, the sharp volume distribution is desired.

The toner contains binder resin, coloring agent and additives such as electrification controlling agent as desired. It is preferable that hydrophobic colloidal silica fine particles are added to the toner.

Examples of the binder resin materials are styrene-acrylic acid-ester resin, styrene-methacryl acid-ester resin or other styrene copolymer or polyester resin. Particularly, when the color mixture in the fixing operation of the toner image by the non-magnetic color toner in an image forming apparatus, the polyester resin is preferable since it provides a sharp fusing property.

The developer described above is contained in the developing device of FIGS. 4 and 6, and the images have been formed under the following conditions:

Drum: 80 mmϕ, OPC, peripheral speed of 160 mm/sec

Sleeve: 32 mmϕ, stainless steel having the surface sand-blasted

Peripheral speed: 280 mm/sec

Latent image contrast (difference in the dark portion potential and the light portion potential): 300 V Fog removing potential: 150 V (difference between the light portion potential and the DC component of the developing bias)

AC component of the developing bias: 2.0 KVpp 2.0 kHz

Gap between sleeve and drum: 500 microns

Gap between sleeve and developer layer regulating blade: 800 microns

Developing magnetic pole: 1000 Gauss

When the apparatus was operated for a long period of time, the above-described image defects attributable to the agglomeration of the toner were suppressed in the produced images.

When the small particle size toner having the volume average particle size of not more than 10 microns, the binder of which was polyester resin was used, it had the sharp fusing property, but on the other hand, it was so soft that it was easily agglomerated and fused into a mass with slight stress. In addition, the agglomeration was strong because the particle size was small. Despite the AC electric field application at the developing station for the purpose of increasing the developing power, the good images without remarkable white spots or white stripes were produced from the start of the operation for a long period (more specifically, several hundreds thousands copies on A4 size sheets).

The developing devices shown in FIGS. 8 and 9 were operated under the same conditions, and it was confirmed that the image defects were not remarkable, and the developer did not leak to the bearing 12 even after a long term operation thereof. The inconvenience that the developer entered the bearing 12 to increase the driving load for the sleeve **10*b*** became too large.

When the ten point average roughness Rz (Japanese Industrial Standard) of the surface of the developer carrying member is not less than 1 micron, the developer containing the toner having the particle size around 10 microns were so influenced by the surface roughness that the toner conveying power is steeply increased. In consideration of this, the portion A of the sleeve carrying the developer to be supplied to the image formation region of the photosensitive member is sand-blasted to provide the surface roughness Rz of not less than 1.5 microns and not more than 5.0 microns in order to increase the developer conveying power under any ambient condition. In place of the sandblasting treatment, it may be treated by sand paper or the like (U.S. Pat. Nos. 4,377,332 and 4,380,966). However, if the sealing effect by the magnetic brush at the end portions is desired, it is not preferable that the developer is moved strongly by the conveying force provided by the developer carrying member at the free ends of the magnetic brush formed by the magnetic plate 21. This is because the end sealing effect is reduced by the strong movement of the developer at the free ends of the magnetic brush adjacent the longitudinal ends of the sleeve, and because the strong movement of the developer separates the toner and the carrier with the result of easily scattering toner. The toner having a sharp fusing property using the polyester resin as the binder moves strongly together with the carrier at the same portion adjacent to the ends of the magnetic brush for a long period of time. When the separated toner increases, the toner becomes easily agglomerated around the separated toner. Then, the non-contact type sealing effect is not sufficiently used as the case may be.

Figure 10:
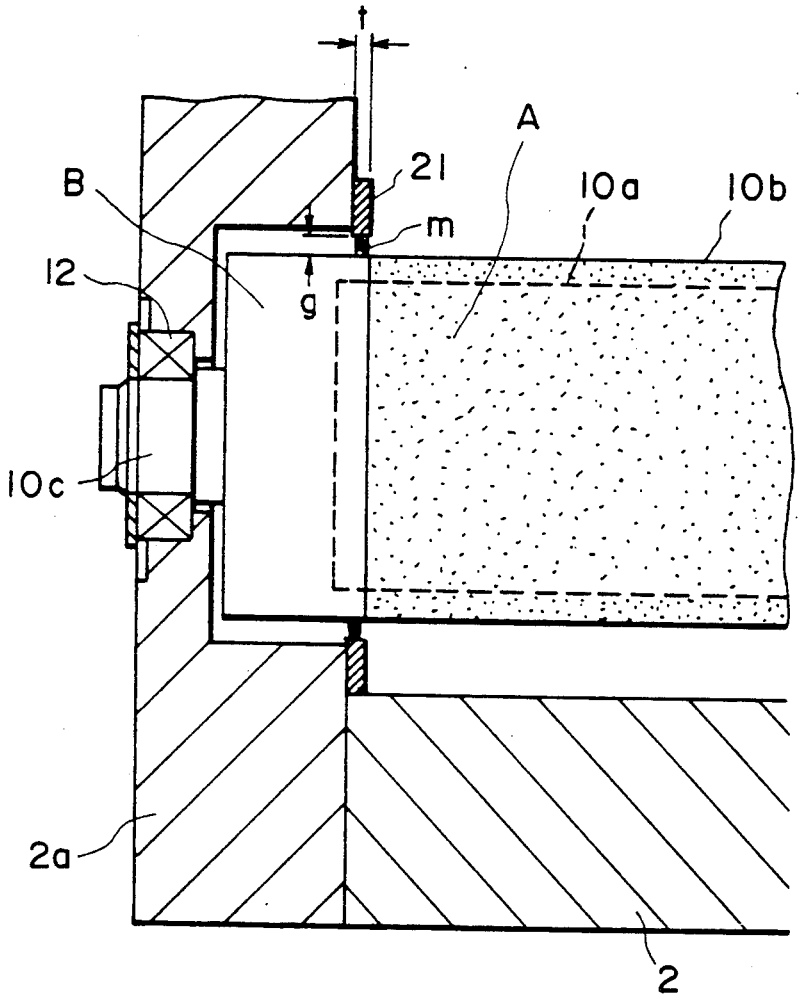
FIG. 10 is a partial cross-sectional view of a developing apparatus according to a yet further embodiment of the present invention.
Figure 11:
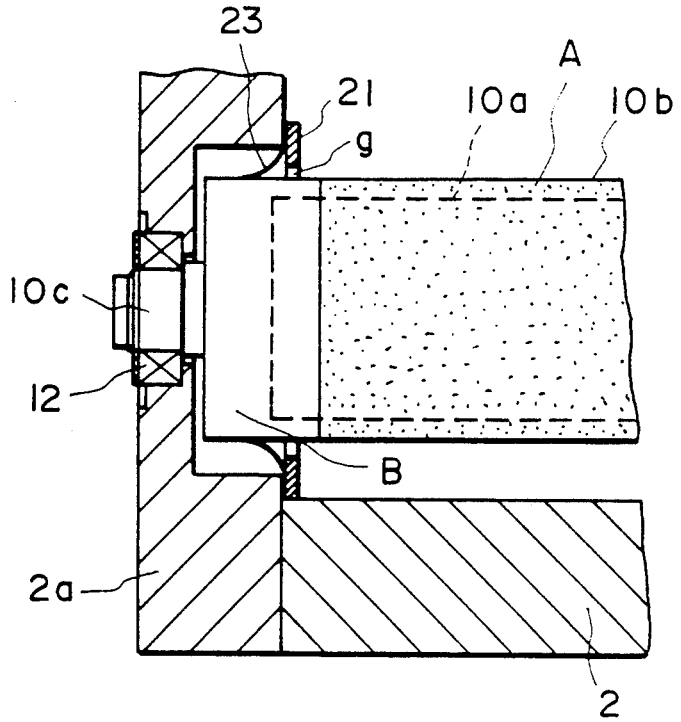
FIG. 11 is a partial cross-sectional view of a portion of a developing apparatus according to a further embodiment of the present invention.
Figure 12:
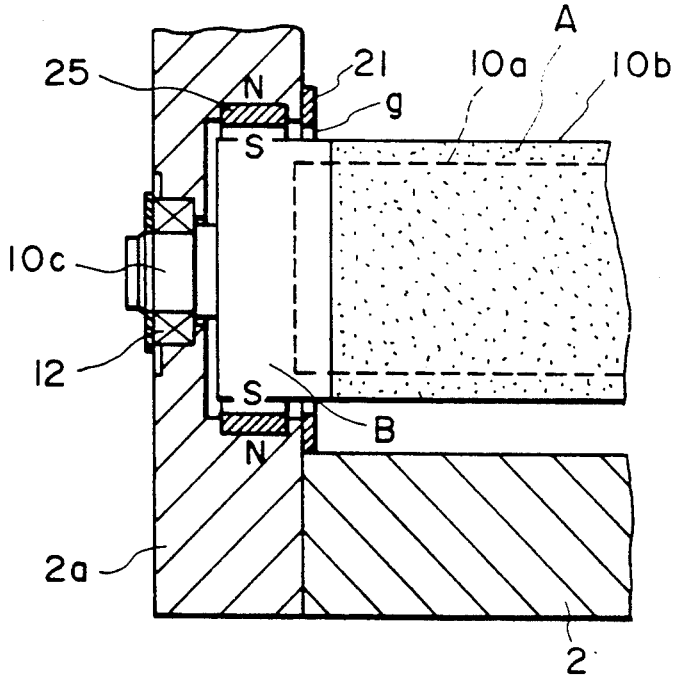
FIG. 12 is a partial cross-sectional view of a portion of a developing apparatus according to a further embodiment of the present invention.

In consideration of these points, the surface portions B of the developer carrying member which is contacted with the high density magnetic brush m functioning as the end seal is made such a smooth surface as has the ten point average roughness Rz of not more than 1 microns. More particularly, the surface roughness in the longitudinally end regions B of the sleeve **10*b* to which the magnetic member 21 is faced is made so smooth as Rz not more than 1 microns. This suppresses the force applied from the sleeve to the free ends of the magnetic brush and therefore, the end seals function properly for a long period of time, with sufficient stability even if the small size polyester toner having the sharp fusing property is used. In the example of FIGS. 10, 11 and 12, above paragraph, the auxiliary sealing members 23 and 25** are faced to the regions B.

The surface portion B at each of the opposite longitudinal ends to which the magnetic brush m is contacted is such a portion that through it, the lines of magnetic force from each of the longitudinal end of the magnet 10*a* to the magnetic plate 21 are concentrated, and it includes at least the closest point between the magnetic plate 21 and the developing sleeve 10*b*. The region b is magnetically influenced to a significant degree by the magnetic permeability of the magnetic member 21 and the magnetic force of the magnet 10*a*, and therefore, it is as large as possible provided that the image is not adversely influenced.

The developer described above was contained in the developing device of FIG. 10, and the image was produced under the following conditions:

Drum: 82 mmϕ, OPC, 160 mm/sec of peripheral speed

Sleeve: 32 mmϕ, stainless steel, 280 mm/sec of peripheral speed

Latent image contrast: 300 V

Fog removing potential: 150 V (difference between the light portion potential and the DC component of the developing bias)

Region A of the sleeve: sandblasted to Rz=1.8 microns

Region B of the sleeve surface: Rz=0.8 microns

AC component of developing bias: 2.0 KVpp, 2.0 KHz

Sleeve-drum gap: 500 microns

Sleeve-blade gap: 800 microns

Developing pole S1: 1000 Gauss

When the apparatus was operated for a long period of time, the above-described image defects attributable to the agglomeration of the toner were suppressed in the produced images.

When the small particle size toner having the volume average particle size of not more than 10 microns, the binder of which was polyester resin was used, it had the sharp fusing property, but on the other hand, it was so soft that it was easily agglomerated and fused into a mass with slight stress. In addition, the agglomeration was strong because the particle size was small. Despite the AC electric field application at the developing station for the purpose of increasing the developing power, the good images without remarkable white spots or white stripes were produced from the start of the operation for a long period (more specifically, several hundreds thousands copies on A4 size sheets).

The developing devices shown in FIGS. 11 and 12 were operated under the same conditions, and it was confirmed that the image defects did not occur, and the developer did not leak to the bearing 12 even after the long term operation thereof. The inconvenience that the developer entered the bearing 12 to increase the driving load for the sleeve 10*b* became too large.

Figure 13:
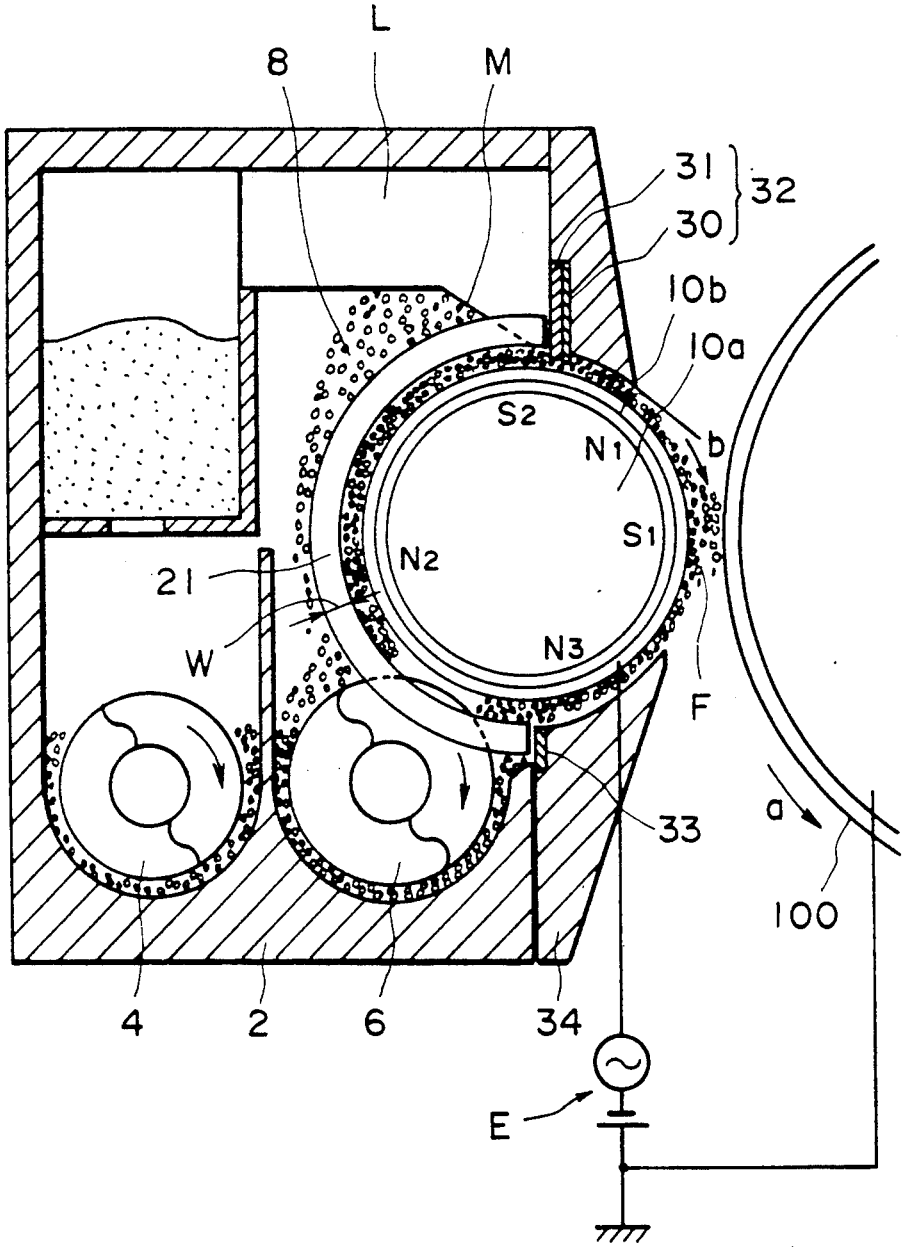
FIG. 13 is a cross-sectional view of a developing apparatus according to a further embodiment of the present invention.

Toner particles deposited on the magnetic particles with small deposition force, the toner not sufficiently charged and the toner charged to the opposite polarity are easily separated from the carrier and are scattered. Particularly, the toner particles for the full-color image formation has a small toner particle size in consideration of the high quality image and the high color mixing property. In addition, the sharp melting property is desired. Therefore, polyester binder toner is used. The toner is excellent in the quality of the image, but involves the drawback that in the changed ambient condition (particularly under the high humidity condition, the triboelectric charging ability of the toner itself changes (decreases) with the result of being easily scattered). In addition, such toner is easily deteriorated under the strong mechanical stress at the developer discharging outlet of the container and the developer inlet thereof. Therefore, the prevention of the scattering or the deterioration of the toner is prevented at the outlet and the inlet. The embodiment of FIG. 13 provides the solution to this problem, too.

Figure 14:
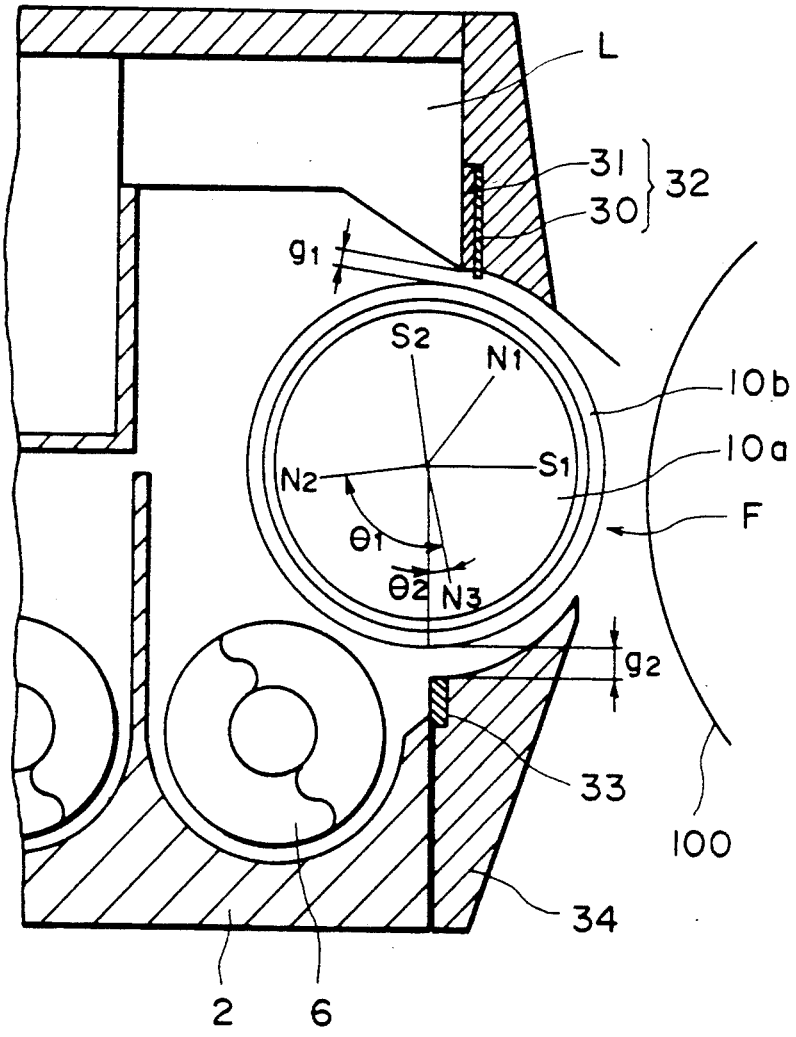
FIG. 14 is a cross-sectional view of a part of the developing apparatus of FIG. 13.

In FIG. 14, the developer container 2 is provided with an opening at a position close to the latent image bearing member 100, and in the opening, the developing sleeve 10*b* is rotatably disposed. Above the developing sleeve 10*b*, a developer layer thickness regulating member 32 is mounted with a predetermined gap from the sleeve. Below the developing sleeve 10*b*, a magnetic member 33 is mounted with a predetermined gap from the sleeve 10*b*.

The regulating member 32 includes an integrated non-magnetic blade 30 and a magnetic blade 31. The non-magnetic blade 30 is made of non-magnetic material such as aluminum, non-magnetic stainless steel or the like. The blade 31 is made of magnetic material such as steel or magnetic stainless steel. An end of the non-magnetic blade 30 is closer to the sleeve 10*b* than the end of the magnetic blade 31. As described hereinbefore, a predetermined gap is formed from the surface of the developing sleeve 10*b* and is extended along the length of the sleeve. The gap regulates the quantity of the developer carried on the developing sleeve 10*b* to the developing station, that is, the thickness of the developer layer formed on the developing sleeve 10*b*. The magnetic blade 31 is influenced by the lines of magnetic force provided by the magnetic pole S2 slightly upstream of the regulating member 32 with respect to the rotational direction of the sleeve 10*b* to form a magnetic brush, by which the layer thickness regulating function by the non-magnetic blade 30 is assisted, thus reducing the stress applied to the developer during the regulating action. In addition, the passage of excessive developer can be prevented, and therefore, the toner scattering in the region downstream of the outlet is suppressed.

In this embodiment, both of the non-magnetic toner and the magnetic particles are passed through the gap between the free end of the blade 30 and the surface of the developing sleeve 10*b* and are carried to the developing station.

Below the sleeve 10*b* and slightly downstream of the magnetic pole N3 with respect to the rotational direction of the sleeve, a magnetic member 33 is extended along the length of the sleeve. It may be made of magnetic material such as steel or magnet.

In this embodiment, the magnetic member 33 has a thickness of 0.5 mm and a width of 5 mm made of steel.

In a developing apparatus using a repelling magnetic field provided by the same polarity magnetic poles N2 and N3, the lines of magnetic force by the magnetic pole N3 does not extend toward the magnetic pole N2, and are significantly concentrated on the opposite polarity magnetic pole S1, and therefore, the magnetic flux density from the magnetic pole N3 to the magnetic pole S1 is increased.

Therefore, in the structure as in this embodiment wherein the magnetic member 33 is not used, the erection of the magnetic brush of the developer 8 formed on the developing sleeve adjacent the magnetic pole N3 is large and long toward the magnetic pole S1, and it is of high density, and therefore, it obstructs the developer returning into the developer container 2 having been conveyed on the sleeve 10*b* from the developing station F. This can results in that the toner is scattered, or that the developer is not properly returned into the developer container. In the experiments using the polyester binder toner (color toner described in the foregoing) which is easily painted, the brush of the developer having the high density and having large size and length adjacent to the magnetic pole N3 is strongly contacted with and rubbed with the bottom sealing member 34 covering a part of a sleeve with the result that the toner is separated, fused and agglomerated, and that the agglomerations are sequentially enter the developer container 2 and can be deposited on the image. However, when the magnetic member 33 is used as in this embodiment, the lines of magnetic force by the magnetic pole N3 are partly concentrated on the magnetic member 33, and then directed to the magnetic pole S1 with large arcuation, and therefore, no strong magnetic flux is not formed from the magnetic pole N3 to the magnetic pole S1.

Therefore, adjacent the magnetic pole N3, the magnetic brush of the developer 8 formed on the sleeve 10*b* by the corporation between the magnetic pole N3 and the magnetic member 33 is concentrated on the magnetic member 33 so that the magnetic brush provides the magnetic sealing effects to prevent the leakage through the inlet. The magnetic brush of the developer extending from the magnetic pole N3 position toward the magnetic pole S1 is small, and therefore, the developer having been conveyed from the developing station F on the sleeve 10*b* and being returned into the container 2 does not increase in the layer thickness thereof, and the magnetic brush of the developer does not contact the bottom sealing member 34. They are confirmed in the experiments.

The magnetic brush formed between the magnetic member 33 and the magnetic pole N3 is partly retained on the magnetic member 33 due to the balance between the confining force such as the magnetic confining force or the mirror force or the like and the friction force provided by the rotation of the sleeve 10*b*, and the other is sequentially taken into the developer container 2, and it falls into the container by the repelling magnetic field.

The magnetic brush formed between the magnetic pole N3 and the magnetic member 33 acts softly on the developer which has been confined and carried on the sleeve 10*b* from the developing position and which is being returned into the developer container 2, and therefore, the toner is not separated for scattered by impact, and the toner is not separated or scattered by impact, and the proper returning of the developer into the container is maintained. Thus, the good sealing effect can be maintained.

As contrasted to the comparison example without the member 33, the problem that the toner is separated and agglomerated, that the agglomerations are sequentially enters the developer container and that the agglomerations are deposited on the image has not occurred.

The description will be made as to the position of the magnetic member 33.

In FIG. 14, $\theta 1$ is an angle formed between the line connecting the rotational center of the sleeve 10*b* and the center of the magnetic pole N2 and the line connecting the center of the sleeve 10*b* and the center of the magnetic pole N3, and $\theta 2$ is an angle formed between the line connecting the rotational center of the sleeve 10*b* and the pole center of the magnetic pole N3 and the line connecting the center of the sleeve 10*b* and the position where the magnetic member 33 and the sleeve 10*b* are closest. In the case where the $\theta$ is zero or negative ("negative" means that the magnetic member 33 is upstream of the magnetic pole N3 with respect to the rotational direction of the sleeve 10*b*), the lines of magnetic force by the magnetic pole N3 are strongly concentrated on the magnetic member 33. Therefore, the magnetic brush of the developer formed on the sleeve 10*b* adjacent to the magnetic pole N3 is large and of high density, and therefore, is a bar to the developer which has been carried on the sleeve 10*b* from the developing position F and which is being returned into the developer container 2, with the result that the developer is not returned, and spilled outside the container. On the other hand, with the magnetic member 33 approaching the magnetic pole N2, the concentration of the magnetic lines of force of the magnetic pole N3 becomes weaker, so that the magnetic sealing effect becomes weaker.

The experiments of the Inventors have revealed that the above-described magnetic sealing effect, the developer receiving effect and the toner scattering preventing effect are not satisfactory when $0<\theta 2<5$ degrees. In the range of $(\frac{1}{3})\theta 1<\theta 2$, the magnetic member 33 does not have any effect. The range in which the magnetic sealing effect, the developer receiving effect and the toner scattering preventing effect are all sufficient in the following range:

$$5 \text{ degrees} \leqq \theta 2 \leqq (\tfrac{1}{3})\theta 1.$$

This has been empirically confirmed.

The description will be made as to the relation between the gap $g_2$ between the magnetic member 33 and the developing sleeve 10*b* and the gap $g_1$ between the developer regulating blade 30 and the developing sleeve 10*b*.

The amount of the developer 8 (thickness t) on the sleeve 9*b* is regulated by the gap $g_1$, so that the thickness t is generally equal to the gap $g_1$.

At the magnetic brush formed between the magnetic pole N3 and the magnetic member 33, as described hereinbefore, a part of the developer is retained on the magnetic member 33, and therefore, the thickness of the developer passing through the gap between the sleeve 10*b* and the magnetic member 33 is smaller than the gap $g_2$. Therefore, in order to accomplish the proper receiving of the developer by the container 2, it has been found that $g_1<g_2$.

The embodiments of FIGS. 10, 11 and 12 may be incorporated to the apparatus of FIGS. 13 and 14.

The present invention is applicable to a monochromatic image forming apparatus as well as the full-color image forming apparatus.

These and other objects, features and advantages of the present invention will become more apparent upon a consideration of the following description of the preferred embodiments of the present invention taken in conjunction with the accompanying drawings.

What is claimed is:

1. A developing apparatus, comprising:

a container for accommodating a developer containing magnetic particles;

a rotatable developer carrying member, disposed at least partly in said container, for facing an image bearing member at a developing position and for carrying the developer thereon to the developing position;

a magnet disposed in said developer carrying member, said magnet comprising a plurality of magnets for conveying the developer; and a magnetic member disposed closely to a circumferential surface of said developer carrying member and in a circumferential direction of said developer carrying member in a region thereof where said developer carrying member is disposed in said developer container, adjacent a longitudinal end of said developer carrying member, wherein said magnetic member is magnetized by said magnet, and wherein said magnetic member cooperates with said magnet to form a magnetic field for forming a magnetic brush of the developer in a gap between said magnetic member and said developer carrying member.

2. An apparatus according to claim 1, further comprising a bearing for rotatably supporting said developer carrying member, said bearing being disposed adjacent the longitudinal end and longitudinally outside said magnetic member.

3. An apparatus according to claim 2, wherein said magnetic member is in the form of a plate, and an angle formed between a surface of the plate and a line perpendicular to the surface of the developer carrying member is not more than 45 degrees.

4. An apparatus according to claim 1, 2 or 3, wherein a gap between said magnetic member and said developer carrying member is 0.3–2 mm.

5. An apparatus according to claim 1, 2 or 3, further comprising a power source for applying a developing bias voltage including an AC component to said developer carrying member to form an alternating electric field in the developing position.

6. A developing apparatus comprising:

a container for accommodating a developer containing magnetic particles;

a rotatable developer carrying member, disposed at least partly in said container, for facing an image bearing member at a developing position and for carrying the developer thereon to the developing position;

a magnet disposed in said developer carrying member;

a magnetic member disposed closely to and along said developer carrying member and in a region thereof where said developer carrying member is disposed in said developer container, adjacent a longitudinal end of said developer carrying member, wherein said magnetic member cooperates with said magnet to form a magnetic field for forming a magnetic brush of the developer in a gap between said magnetic member and said developer carrying member;

a bearing for rotatably supporting said developer carrying member, said bearing being disposed adjacent the longitudinal end and longitudinally outside said magnetic member; and an auxiliary sealing member disposed between a position between said magnetic member and said bearing with respect to a longitudinal direction of said developer carrying member.

7. An apparatus according to claim 6, wherein said auxiliary sealing member includes an elastic sheet contacted to said developer carrying member.

8. An apparatus according to claim 6, wherein said auxiliary sealing member comprises a sealing magnet faced to said developer carrying member having a gap therebetween.

9. A developing apparatus, comprising:

a container for accommodating a developer containing magnetic carrier particles and toner particles, wherein a volume content of such toner particles of the toner particles as has particle sizes satisfying $(\frac{1}{2})M<r<(3/2)M$, where M is a volume average particle size of the toner and r is a particle size of a toner particle is not less than 90% by volume, and wherein a content of such a toner particles as has particle sizes satisfying $0<r<2M$ is not less than 99% by volume, and wherein M is not more than 12 microns; 'a rotatable developer carrying member, disposed at least partly in said container, for facing an image bearing member at a developing position and for carrying the developer thereon to the developing position;

a magnet disposed in said developer carrying member, said magnet comprising a plurality of magnets for conveying the developer; and a magnetic member disposed closely to a circumferential surface of said developer carrying member and in a circumferential direction of said developer carrying member in a region thereof where said developer carrying member is disposed in said developer container, adjacent a longitudinal end of said developer carrying member, wherein said magnetic member is magnetized by said magnet, and wherein said magnetic member cooperates with said magnet to form a magnetic field for forming a magnetic brush of the developer in a gap between said magnetic member and said developer carrying member.

10. An apparatus according to claim 9, further comprising a bearing for rotatably supporting said developer carrying member, said bearing being disposed adjacent the longitudinal end and longitudinally outside said magnetic member.

11. An apparatus according to claim 10, wherein said magnetic member is in the form of a plate, and an angle formed between a surface of the plate and a line perpendicular to the surface of the developer carrying member is not more than 45 degrees.

12. An apparatus according to claim 9, 10 or 11, wherein a gap between said magnetic member and said developer carrying member is 0.3–2 mm.

13. An apparatus according to claim 9, 10 or 11, further comprising a power source for applying a developing bias voltage including an AC component to said developer carrying member to form an alternating electric field in the developing position.

14. An apparatus according to claim 9, 10 or 11, wherein an average particle size of the toner particles is not more than 10 microns.

15. An apparatus according to claim 14, wherein a binder resin of the toner particle comprises polyester resin material.

16. A developing apparatus comprising:

a container for accommodating a developer containing magnetic carrier particles and toner particles, wherein a volume content of such toner particles of the toner particles as has particle sizes satisfying $(\frac{1}{2})M<r<(3/2)M$, where M is a volume average particle size of the toner and r is a particle size of a toner particle is not less than 90% by volume, and wherein a content of such a toner particles as has particle sizes satisfying $0<r<2M$ is not less than 99% by volume, and wherein M is not more than 12 microns; 'a rotatable developer carrying member, disposed at least partly in said container, for facing an image bearing member at a developing position and for carrying the developer thereon to the developing position;

a magnet disposed in said developer carrying member;

a magnetic member disposed closely to and along said developer carrying member in a region thereof where said developer carrying member is disposed in said developer container, adjacent a longitudinal end of said developer carrying member, wherein said magnetic member cooperates with said magnet to form a magnetic field for forming a magnetic brush of the developer in a gap between said magnetic member and said developer carrying member;

a bearing for rotatably supporting said developer carrying member, said bearing being disposed adjacent the longitudinal end and longitudinally outside said magnetic member; and an auxiliary sealing member disposed between a position between said magnetic member and said bearing with respect to a longitudinal direction of said developer carrying member.

17. An apparatus according to claim 16 wherein said auxiliary sealing member includes an elastic sheet contacted to said developer carrying member.

18. An apparatus according to claim 16, wherein said auxiliary sealing member comprises a sealing magnet faced to said developer carrying member having a gap therebetween.

19. A developing apparatus, comprising:

a container for accommodating a developer containing magnetic particles;

a rotatable developer carrying member, disposed at least partly in said container, for facing an image bearing member at a developing position and for carrying the developer thereon to the developing position;

a magnet disposed in said developer carrying member, said magnet comprising a plurality of magnets for conveying the developer; and a magnetic member disposed closely to a circumferential surface of said developer carrying member and in a circumferential direction of said developer carrying member in a region thereof where said developer carrying member is disposed in said developer container, adjacent a longitudinal end of said developer carrying member, wherein said magnetic member is magnetized by said magnet, and wherein said magnetic member cooperates with said magnet to form a magnetic field for forming a magnetic brush of the developer in a gap between said magnetic member and said developer carrying member;

wherein said developer carrying member has a rough surface region for carrying the developer to be conveyed to the developing position and a less roughness region to which said magnetic member is faced.

20. An apparatus according to claim 19, further comprising a bearing for rotatably supporting said developer carrying member, said bearing being disposed adjacent the longitudinal end and longitudinally outside said magnetic member.

21. An apparatus according to claim 20, wherein the region of said developer carrying member to which said magnetic member is faced has a surface roughness Rz not more than 1 micron.

22. An apparatus according to claim 21, wherein said rough surface portion has a surface roughness Rz of more than 1.5 microns.

23. An apparatus according to any one of claims 19-22, wherein said magnetic member is in the form of a plate, and an angle formed between a surface of the plate and a line perpendicular to the surface of the developer carrying member is not more than 45 degrees.

24. An apparatus according to any one of claims 19-22, wherein a gap between said magnetic member and said developer carrying member is 0.3-2 mm.

25. An apparatus according to any one of claims 19-22, further comprising a power source for applying a developing bias voltage including an AC component to said developer carrying member to form an alternating electric field in the developing position.

26. An apparatus according to any one of claims 19-22, wherein said container accommodates a developer containing magnetic particles and toner particles, wherein a volume content of such toner particles of the toner particles as has particle sizes satisfying $(\frac{1}{2})M<r<(3/2)M$, where M is a volume average particle size of the toner and r is a particle size of a toner particle is not less than 90% by volume, and wherein a content of such a toner particles as has particle sizes satisfying $0<r<2M$ is not less than 99% by volume, and wherein M is not more than 12 microns.

27. An apparatus according to claim 26, wherein the toner particles have a volume average particle size of not more than 10 microns.

28. An apparatus according to claim 27, wherein a binder of a toner particle comprises polyester resin.

29. A developing apparatus comprising:

a container for accommodating a developer containing magnetic particles;

a rotatable developer carrying member, disposed at least partly in said container, for facing an image bearing member at a developing position and for carrying the developer thereon to the developing position;

a magnet disposed in said developer carrying member;

a magnetic member disposed closely to and along said developer carrying member in a region thereof where said developer carrying member is disposed in said developer container, adjacent a longitudinal end of said developer carrying member, wherein said magnetic member cooperates with said magnet to form a magnetic field for forming a magnetic brush of the developer in a gap between said magnetic member and said developer carrying member;

wherein said developer carrying member has a rough surface region for carrying the developer to be conveyed to the developing position and a less roughness region to which said magnetic member is faced;

a bearing for rotatably supporting said developer carrying member, said bearing being disposed adjacent the longitudinal end and longitudinally outside said magnetic member; and an auxiliary sealing member disposed between a position between said magnetic member and said bearing with respect to a longitudinal direction of said developer carrying member.

30. An apparatus according to claim 29, wherein said auxiliary sealing member includes an elastic sheet contacted to said developer carrying member.

31. An apparatus according to claim 29, wherein said auxiliary sealing member comprises a sealing magnet faced to said developer carrying member having a gap therebetween.

32. A developing apparatus, comprising:

a container for accommodating a developer containing magnetic particles;

a rotatable developer carrying member, at least partly disposed in said container, for facing an image bearing member at a developing position and for carrying thereon a layer of the developer to the developing position;

a magnet disposed in said developer carrying member, said magnet comprising a plurality of magnets for conveying the developer;

a first magnetic member disposed closely to a circumferential surface of said developer carrying member and in a circumferential direction of said developer carrying member and disposed closely thereto in a region of said developer carrying member which is in said developer container, adjacent a longitudinal end of said developer carrying member, wherein said first magnetic member is magnetized, and wherein said first magnetic member cooperates with said magnet to form a magnetic field for forming a magnetic brush of the developer in a gap between said first magnetic member and said developer carrying member;

a second magnetic member extending along a length of said developer carrying member and disposed closely to said developer carrying member at a developer outlet where the developer layer is discharged from said container by said developer carrying member, wherein said second magnetic member is disposed within influence of magnetic field provided by said magnet; and a third magnetic member disposed closely to said developer carrying member along a length thereof adjacent an inlet where the developer having passed through the developing position is introduced into said container by said developer carrying member, said third magnetic member is within influence of magnetic field by said magnet.

33. An apparatus according to claim 32, further comprising a bearing for rotatably supporting said developer carrying member, said bearing being disposed adjacent the longitudinal end and longitudinally outside said first magnetic member.

34. An apparatus according to claim 33, wherein said first magnetic member is in the form of a plate, and an angle formed between a surface of the plate and a line perpendicular to the surface of the developer carrying member is not more than 45 degrees.

35. An apparatus according to claim 32, 33 or 34, wherein a gap between said first magnetic member and said developer carrying member is 0.3–2 mm.

36. An apparatus according to claim 32, 33 or 34, further comprising a power source for applying a developing bias voltage including an AC component to said developer carrying member to form an alternating electric field in the developing position.

37. An apparatus according to any one of claims 32–34, wherein said container accommodates a developer containing magnetic particles and toner particles, wherein a volume content of such toner particles of the toner particles as has particle sizes satisfying $(\frac{1}{2})M < r < (3/2)M$, where M is a volume average particle size of the toner and r is a particle size of a toner particle is not less than 90% by volume, and wherein a content of such a toner particles as has particle sizes satisfying $0 < r < 2M$ is not less than 99% by volume, and wherein M is not more than 12 microns.

38. An apparatus according to claim 37, wherein the toner particles have a volume average particle size of not more than 10 microns.

39. An apparatus according to claim 38, wherein a binder of the toner particle comprises polyester resin.

40. A developing apparatus comprising:

a container for accommodating a developer containing magnetic particles;

a rotatable developer carrying member, at least partly disposed in said container, for facing an image bearing member at a developing position and for carrying thereon a layer of the developer to the developing position;

a magnet disposed in said developer carrying member;

a first magnetic member extended along a surface of said developer carrying member and disposed closely thereto in a region of said developer carrying member which is disposed in said developer container, adjacent a longitudinal end of said developer carrying member, said first magnetic member is disposed within influence of said magnet;

a second magnetic member extending along a length of said developer carrying member and disposed closely to said developer carrying member at a developer outlet where the developer layer is discharged from said container by said developer carrying member, wherein said second magnetic member is disposed within influence of magnetic field provided by said magnet; and a third magnetic member disposed closely to said developer carrying member along a length thereof adjacent an inlet where the developer having passed through the developing position is introduced into said container by said developer carrying member, said third magnetic member is within influence of magnetic field by said magnet;

a bearing for rotatably supporting said developer carrying member, said bearing being disposed adjacent the longitudinal end and longitudinally outside said first magnetic member; and an auxiliary sealing member disposed between a position between said first magnetic member and said bearing with respect to a longitudinal direction of said developer carrying member.

41. An apparatus according to claim 40, wherein said auxiliary sealing member includes an elastic sheet contacted to said developer carrying member.

42. An apparatus according to claim 40, wherein said auxiliary sealing member comprises a sealing magnet faced to said developer carrying member having a gap therebetween.

* * * * *

UNITED STATES PATENT AND TRADEMARK OFFICE

CERTIFICATE OF CORRECTION

PATENT NO. : 5,177,536

DATED : January 5, 1993

INVENTOR(S) : WATANABE ET AL.

It is certified that error appears in the above-identified patent and that said Letters Patent is hereby corrected as shown below:

On title page, item

[56] REFERENCES CITED

Insert: -- 2-262171 10/90 Japan-- and
-- 2-188292 7/90 Japan--.

"4,777,107 10/1988 Kurematsu et al." should read
--4,777,107 10/1980 Kurematsu et al.--.

"58-29479 6/1982 Japan" should read
--58-29479 6/1983 Japan--.

COLUMN 1

Line 55, "10b" should read --10b,--.

COLUMN 3

Line 20, "a" (first occurrence) should read --a partial--.

COLUMN 4

Line 32, "degrees" should read --degree--.
Line 51, "voltage" should read --voltage,--.
Line 67, "-photosensitive" should read --photosensitive--.

UNITED STATES PATENT AND TRADEMARK OFFICE

CERTIFICATE OF CORRECTION

PATENT NO. : 5,177,536

DATED : January 5, 1993

INVENTOR(S) : WATANABE ET AL.

It is certified that error appears in the above-identified patent and that said Letters Patent is hereby corrected as shown below:

COLUMN 9

Line 30, "having the" should read --have a--.
Line 31, delete "includes"; change "stuck" to --stick--.
Line 32, delete "includes".

COLUMN 13

Line 11, "results" should read --result--.
Line 21, "are" should be deleted.
Line 66, "are" should be deleted.

COLUMN 15

Line 13, "magnets" should read --magnetic poles--.
Line 57, "and" should be deleted.

COLUMN 16

Line 23, "microns; 'a rotatable" should read --microns; a rotatable--.
Line 29, "magnets" should read --magnetic poles--.

UNITED STATES PATENT AND TRADEMARK OFFICE

CERTIFICATE OF CORRECTION

PATENT NO. : 5,177,536

DATED : January 5, 1993

INVENTOR(S) : WATANABE ET AL.

It is certified that error appears in the above-identified patent and that said Letters Patent is hereby corrected as shown below:

COLUMN 17

Line 35, "claim 16" should read --claim 16,--.
Line 51, "magnets" should read --magnetic poles--.

COLUMN 19

Line 25, "magnets" should read --magnetic poles--.

Signed and Sealed this

Eighth Day of February, 1994

Bruce Lehman

*Attest:*

BRUCE LEHMAN

*Attesting Officer*

*Commissioner of Patents and Trademarks*